US010704289B1

(12) United States Patent
Poulin

(10) Patent No.: US 10,704,289 B1
(45) Date of Patent: Jul. 7, 2020

(54) INFLATABLE SHELTER

(71) Applicant: Jesse Walsh Poulin, Haiku, HI (US)

(72) Inventor: Jesse Walsh Poulin, Haiku, HI (US)

( * ) Notice: Subject to any disclaimer, the term of this patent is extended or adjusted under 35 U.S.C. 154(b) by 0 days.

(21) Appl. No.: 16/278,602

(22) Filed: Feb. 18, 2019

Related U.S. Application Data

(60) Provisional application No. 62/632,385, filed on Feb. 19, 2018.

(51) Int. Cl.
*E04B 1/34* (2006.01)
*E04H 15/20* (2006.01)

(52) U.S. Cl.
CPC ..... *E04H 15/20* (2013.01); *E04H 2015/201* (2013.01)

(58) Field of Classification Search
CPC ..... E04H 15/20; E04H 2015/201; E04H 2015/206; A63H 33/008; Y10S 135/902
USPC ..... 52/2.18, 2.22, 2.11, 2.16, 80.1, 81.1; 135/124, 96, 902, 95; 49/477.1; 446/220
See application file for complete search history.

(56) References Cited

U.S. PATENT DOCUMENTS 3,742,658 A * 7/1973 Meyer ..... E04H 15/20 52/2.21
3,945,156 A * 3/1976 Hamm ..... E04H 15/20 52/2.17
4,651,478 A * 3/1987 Dahl ..... E04B 1/3211 52/2.15
4,932,169 A * 6/1990 Charbonneau ..... E04H 15/20 52/2.18
5,007,212 A * 4/1991 Fritts ..... E04H 15/20 135/116
5,570,544 A * 11/1996 Hale ..... E04H 15/20 52/2.11
5,987,822 A * 11/1999 McNiff ..... E04H 15/20 135/125
6,260,306 B1 * 7/2001 Swetish ..... E04H 15/20 135/124
8,096,082 B2 * 1/2012 Moran ..... E04H 15/20 52/2.18
8,615,966 B2 * 12/2013 Thompson ..... A63H 33/008 446/221
2002/0083653 A1 * 7/2002 Hilbert ..... E04H 15/20 52/2.17
2009/0249701 A1 * 10/2009 Turcot ..... E04H 15/20 52/2.18

(Continued)

*Primary Examiner* — Chi Q Nguyen
(74) *Attorney, Agent, or Firm* — Werschulz Patent Law, LLC; Patricia P. Werschulz, Esq.

(57) ABSTRACT

A portable shelter having an inflatable frame that is lightweight and collapsible so that it can easily be transported from one place to the next without transporting heavy spars. The inflatable frame has only one external valve for inflation but creates a complex structure of circles, triangles and diamond-like shapes that provide a rigid and stable frame for a plurality of covering shells. The portable shelter adapts to any climate or circumstance by having an outer shell and an inner shell that can be easily modified accordingly. The portable shelter has solar panels that provide power to a power system and a storage battery therein to power an air pump to inflate the portable shelter frame. The portable shelter is completely self-sustaining. A plurality of portable shelters may be arranged into a self-sustaining village for people displaced by poverty, violent conflict and natural disasters.

10 Claims, 15 Drawing Sheets

(56) References Cited

U.S. PATENT DOCUMENTS

2014/0007521 A1* 1/2014 McMahon ..... E04H 3/16
52/2.11

* cited by examiner

INFLATABLE SHELTER

CROSS-REFERENCE TO RELATED APPLICATIONS

This application is a nonprovisional utility application of the provisional patent application Ser. No. 62/632,385, filed in the United States Patent Office on Feb. 19, 2018, and claims the priority thereof and is expressly incorporated herein by reference in its entirety.

TECHNICAL FIELD

The present disclosure relates generally to a portable shelter. More particularly, the present disclosure relates to a portable dome shelter having an inflatable frame that is part of a system for connecting a plurality of portable dome shelters for creating a village-like construction.

BACKGROUND

For all of history, humans have used temporary shelter. For some, temporary shelter is an essential part of a nomadic existence. For others who routinely dwell in permanent structures, temporary shelter is used as a break in the routine or when their permanent structure cannot be occupied.

After a natural disaster, such as severe weather, earthquakes, volcanic eruptions and wildfires, people are displaced from their dwellings and must seek temporary shelter. Human-caused disasters such as armed conflict, political upheaval and economic crisis create large numbers of homeless refugees. Additionally, in urban settings, there is a shortage of low-cost housing to accommodate the number of homeless poor who often live on the streets.

Historically, people have used tents of all shapes and sizes for temporary shelter. The more shelter and amenities provided by the tent, the more elaborate, heavy, complicated and bulky the tent is prior to erection.

Often times after a disaster, mobile homes are brought in to house the displaced. However, these take time to move to the location where they are needed as well as time to connect to utilities. They also do not pack down and have a high cost and weight per person.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed, and it is contemplated that the claims may encompass one or more of the conventional technical aspects discussed herein.

BRIEF SUMMARY

An aspect of an example embodiment in the present disclosure is to provide a portable shelter that is deployable anywhere on Earth. Accordingly, an aspect of an example embodiment in the present disclosure provides a portable shelter that adapts to any climate or circumstance by having an outer shell and an inner shell that can be easily modified according to the climate or circumstance.

Another aspect of an example embodiment in the present disclosure is to provide a portable shelter that is fully portable. Accordingly, the present disclosure provides a portable shelter having an inflatable frame that is lightweight and collapsible so that it can easily be transported from one place to the next without transporting heavy spars.

A further aspect of an example embodiment in the present disclosure is to provide a portable shelter that is self-sustaining. Accordingly, the present disclosure provides a portable shelter having solar panels that provide power to a power system and a battery therein to power an air pump to inflate a portable shelter frame.

Accordingly, the present disclosure describes a portable shelter having an inflatable frame that is lightweight and collapsible so that it can easily transported from one place to the next without transporting heavy spars. The inflatable frame has only one external valve for inflation but creates a complex structure of circles, triangles and diamond-like shapes that provide a rigid and stable frame for a plurality of covering shells. The portable shelter adapts to any climate or circumstance by having an outer shell and an inner shell that can be easily modified accordingly. The portable shelter has solar panels that provide power to a power system and a battery therein to power an air pump to inflate a portable shelter frame. The portable shelter is completely self-sustaining. A plurality of portable shelters may be arranged into a self-sustaining village for people displaced by violent conflict and natural disasters. Other uses include portable shelters for people gathering for celebrating at a music festival or other occasions when large groups of people are temporarily gathered.

The present disclosure addresses at least one of the foregoing disadvantages of other shelters. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
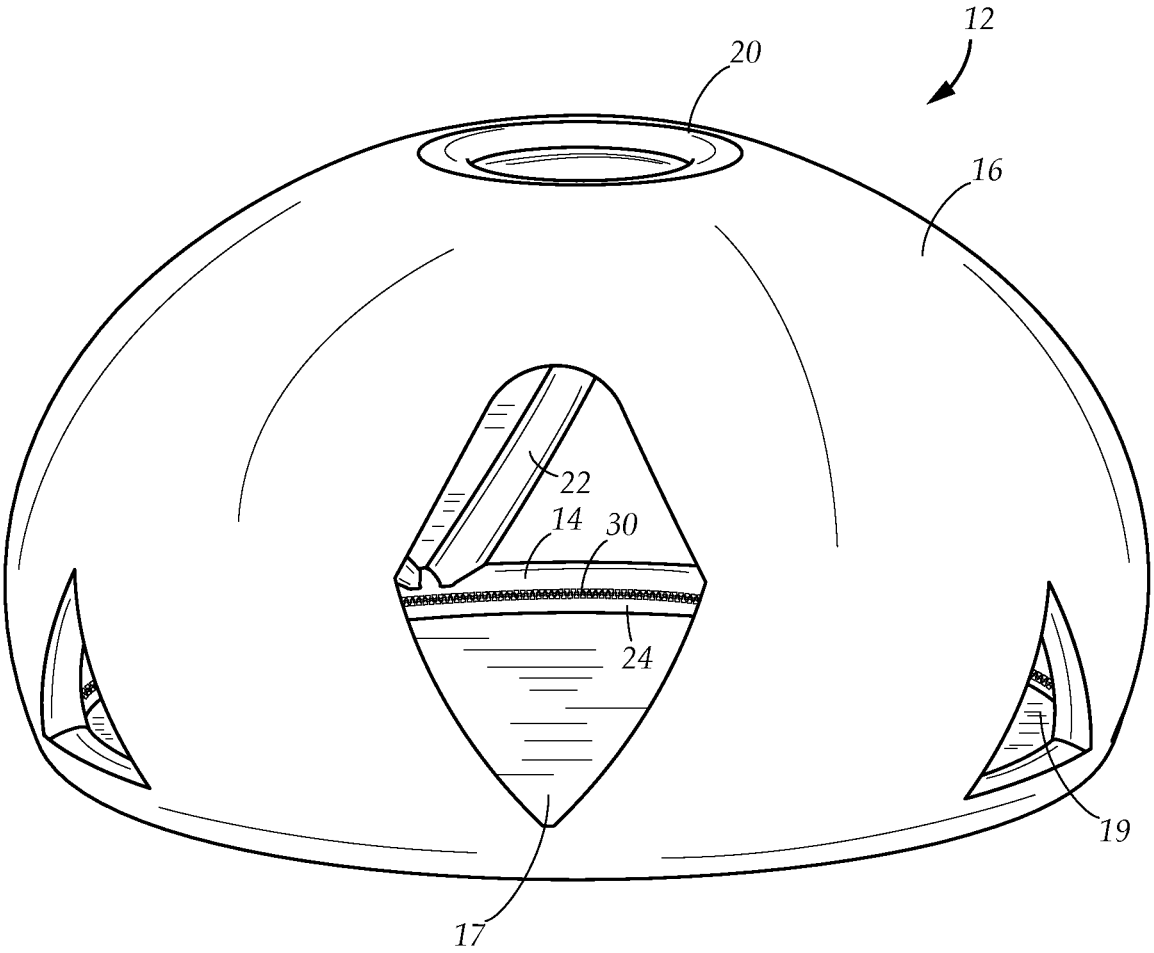
FIG. 1 is a perspective view of an example embodiment of a dome shelter.
Figure 2:
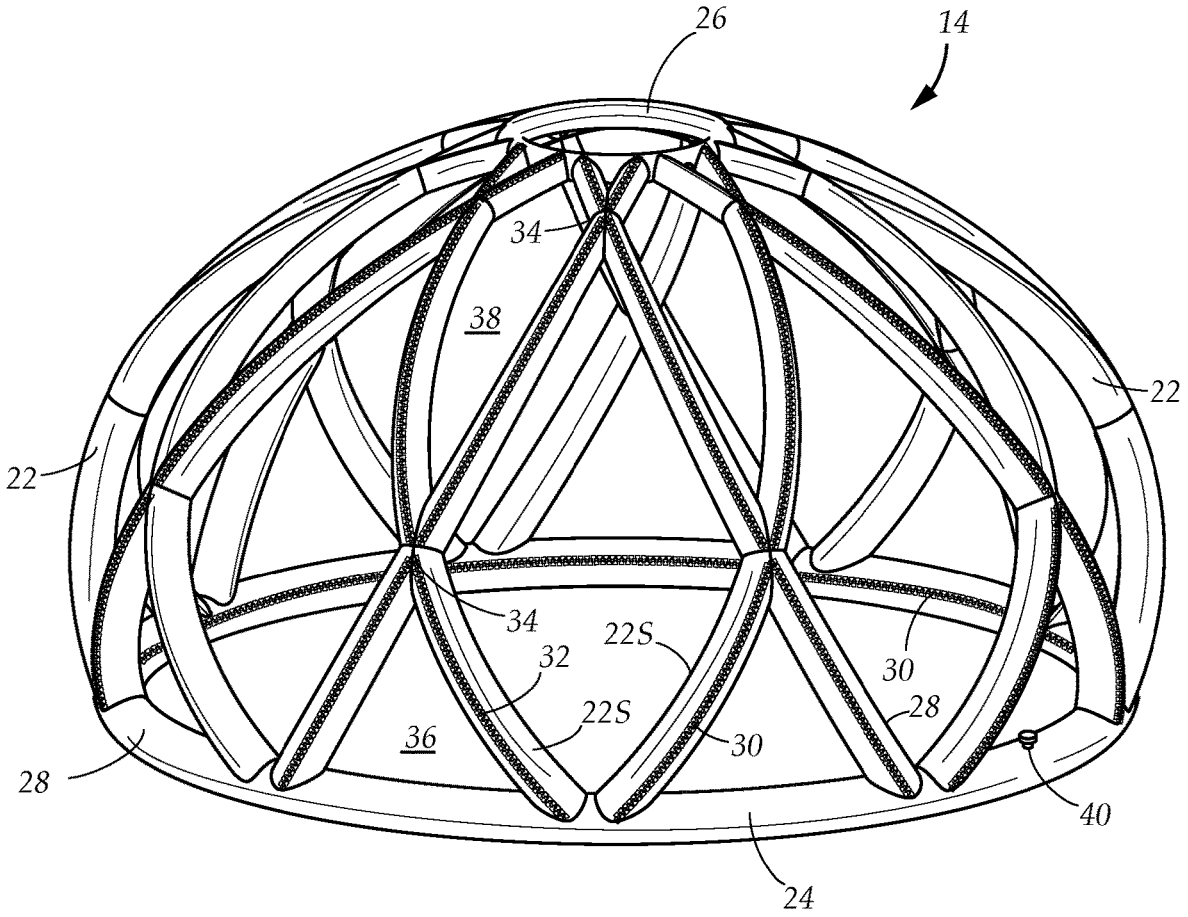
FIG. 2 is a perspective of an example embodiment of a frame of the dome shelter.

FIGS. 1 and 2 illustrate an example embodiment of an inflatable dome shelter 12 suitable for shelter. As shown in the illustration, the dome shelter 12 is configured to stand alone but in other configurations can be joined with other dome shelters as explained hereinbelow.

The dome shelter 12 is supported by a frame 14. The frame 14 is inflatable and a plurality of portions of the frame join together to provide a continuous fluidly connected unitary frame 14. The problem of constructing a dome frame with continuous fluidly connected frame requires that portions of the frame meet at junctions, but creating such a junction is problematic. The entire frame would need to be one long continuous piece but would not be capable of fluidly connecting at a top ring 26 or at a base ring 24.

The present disclosure overcomes the problem of creating inflatable intersecting spars that can fluidly connect to the base or the top of a shelter. In the current disclosure, we will explain how such a complex structure as the unitary frame 14 can be inflated with only one external valve.

The dome shelter 12 has an outer shell 16 constructed from waterproof material in specific shapes to create a weatherproof membrane in a whole form. The shell may also include a door opening 17, a door (not shown), a skylight 20, a plurality of clear vinyl windows 19, as well as typical amenities found in portable shelters such as bug screens, storm flaps, waterproof zippers, vents and shelving.

The outer shell 16 connects to a sleeve 28 on the base ring 24 by a longitudinal fastener 30 such as a zipper. An inner shell that connects to the base ring and forms walls is not illustrated in order to show the frame 14, but similarly, attaches inside the dome shelter 12. In one example embodiment, the inside shell connects at various contact point to the sleeves 28, or to the base ring 24 and or to the top ring 26 of the frame 14.

The composition of the inner shell depends on the intended use of the dome shelter 12. In one embodiment, a 'zip-in' pre-sterilized clean room can be easily installed and then cleanly disposed of. Natural and organic materials would be useful for a family shelter, making the shelter recyclable. Additional insulation materials would be useful for extremely cold areas such as the Artic. Conversely, netting would be useful for tropical areas. The dome shelter adapts to any climate or circumstance by having the outer shell 16 and the inner shell that can be easily modified accordingly. In one example embodiment, a plurality of insulation panels may be placed in within the plurality of spaces formed by the frame 14. In yet another example embodiment, the dome shelter has only an outer shell without an inner shell.

In one example embodiment, both the outer shell 16 and the inner shell are composed of greenhouse material to form a portable greenhouse.

FIG. 2 shows the frame 14 of the dome shelter without the outer shell. The frame 14 has the base ring 24, a top ring 26 and a plurality of spars 22. The spars 22 attach at the top ring 26 and the bottom ring 24 and intersect with each other to form a plurality of triangular shapes 36 and a plurality of quadrangular shapes 38 that have a somewhat diamond-shape. The triangular shapes 36 and quadrangular shapes 38 provide strength and stability to the frame 22.

The spars 22, include a plurality of valves, a plurality of bladders and a plurality of sleeves 28 each having a longitudinal opening 32 that is closed by a closure 30 such a zipper, hook and loop strips and other longitudinal fasteners known to those of ordinary skill in the art. In one embodiment, one sleeve 28 for one spar 22 has a zipper 30 and the remaining sleeves for the remaining spars have hook and loop strip closures. The base ring 24 includes a bladder covered by a sleeve 28 and is in fluid communication with the bladders of the spars 22 through the valves. The top ring 26 includes a bladder covered by a sleeve and is in fluid communication with the bladder of one spar through the valves.

An external valve 40 extends through the sleeve 28 on the base ring 24, allowing inflation of the entire frame 14. This external valve 40 is the only external valve necessary to inflate the unitary frame 14, no other external valves are required for inflation. This allows an air pump to connect to the unitary frame in one spot for inflation. In addition, a plurality of deflation valves, which are not shown, are on each spar and the top ring. The external valve 40 also serves as a deflation valve.

Figure 3A:
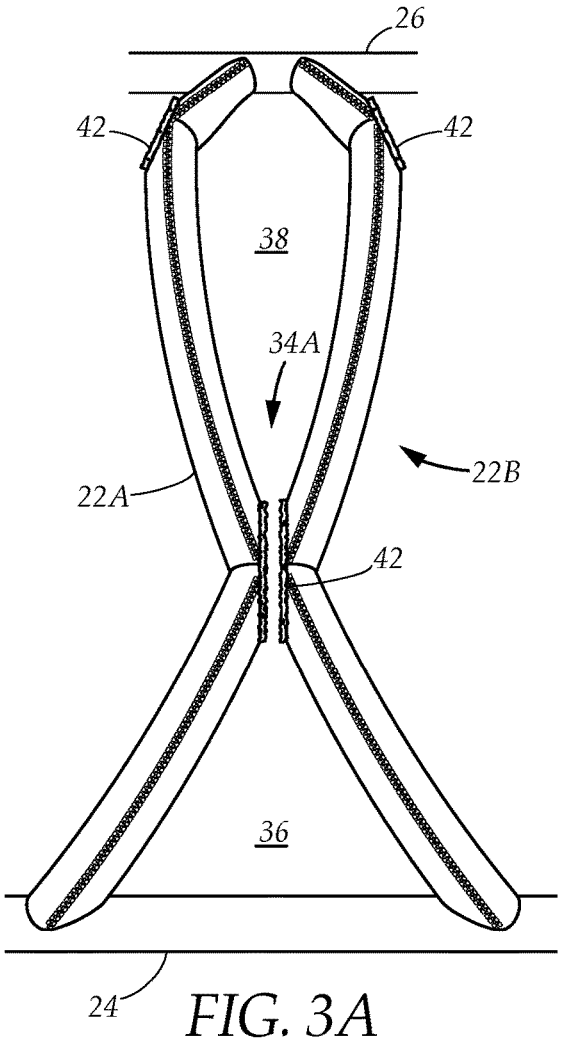
FIG. 3A is perspective view of an example embodiment of an adjacent pair of spars connecting to form a triangle and a diamond.
Figure 3B:
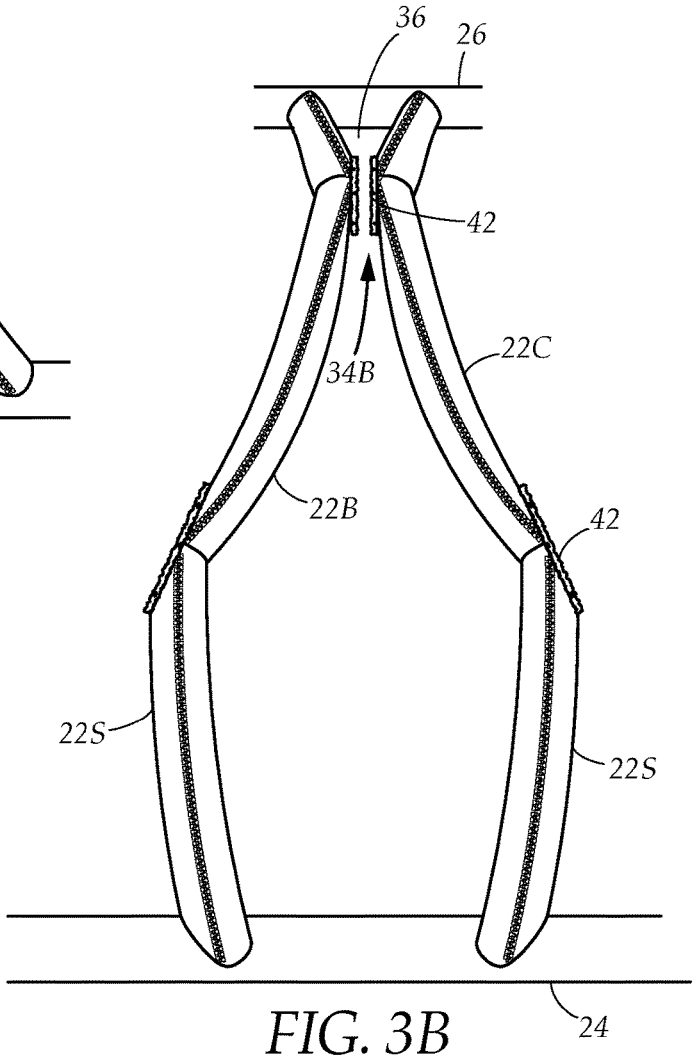
FIG. 3B, similar to FIG. 3A, is a perspective view of an example embodiment of another adjacent pair of spars connecting to form a triangle and a diamond.

FIGS. 3A and 3B show how the spars form triangular shapes 36 and quadrangular shapes 38 yet still can be inflated through one valve. The sleeves 28 have a plurality of couplings, such as hook and loop fasteners and zippers for temporary joining or sewn or welded seams for permanent joining that form the triangular shapes 36 and quadrangular shapes 38.

For the purpose of this disclosure, a coupling 42 is defined as a substance or object used to fix something in position, to stabilize a position or to connect two objects together. While the drawings show hook and loop fasteners, other temporary couplings, such as zippers, snaps, low tack adhesives or interlocking clasps, as non-limiting examples, may be used.

The sleeves 28 have couplings 42 on the sides where the junctions 34 are required to form the triangular shapes 36 and quadrangular shapes 38. The sleeves 28 with adjoining spars 22 are connected at least two junctions 34. A first junction 34*a* connects a first spar 22*a* adjacent to a second spar 22*b* towards the base ring 24 and a second junction 34*b* connects the second spar 22*b* to a third spar 22*c* towards the top ring 26.

As shown in FIG. 2, this pattern continues until all spars 22 connect to the adjoining spars 22 at two junctions 34, one junction on a first side 22S towards the top ring 26 and one junction on a second side 22S towards the base ring 24. It is understood that this example embodiment the arrangement is limited to an even number of spars 22, but configuration is possible with an odd number of spars.

Figure 11:
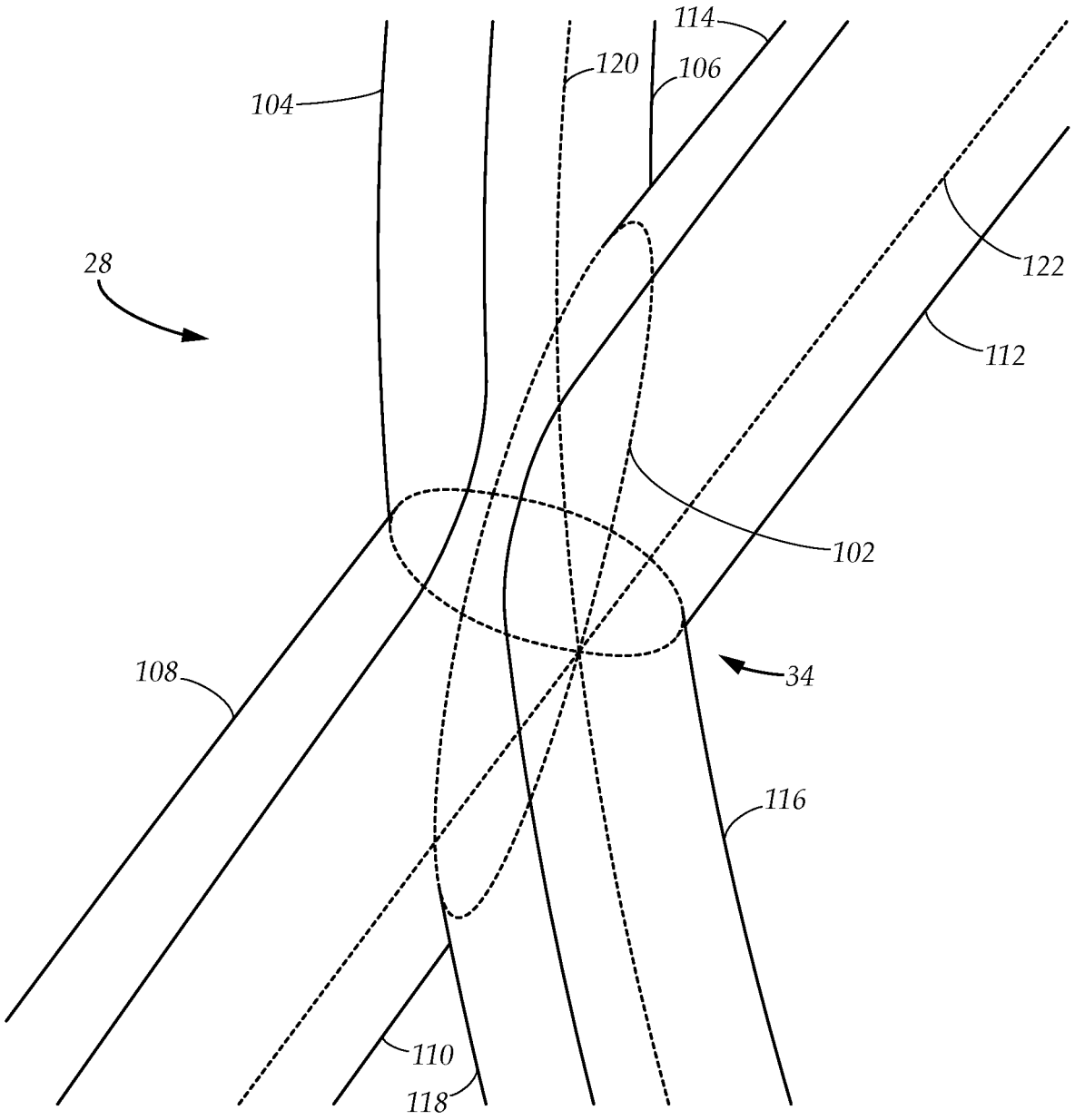
FIG. 11 is a perspective view of a spar junction, showing seam lines.
Figure 12:
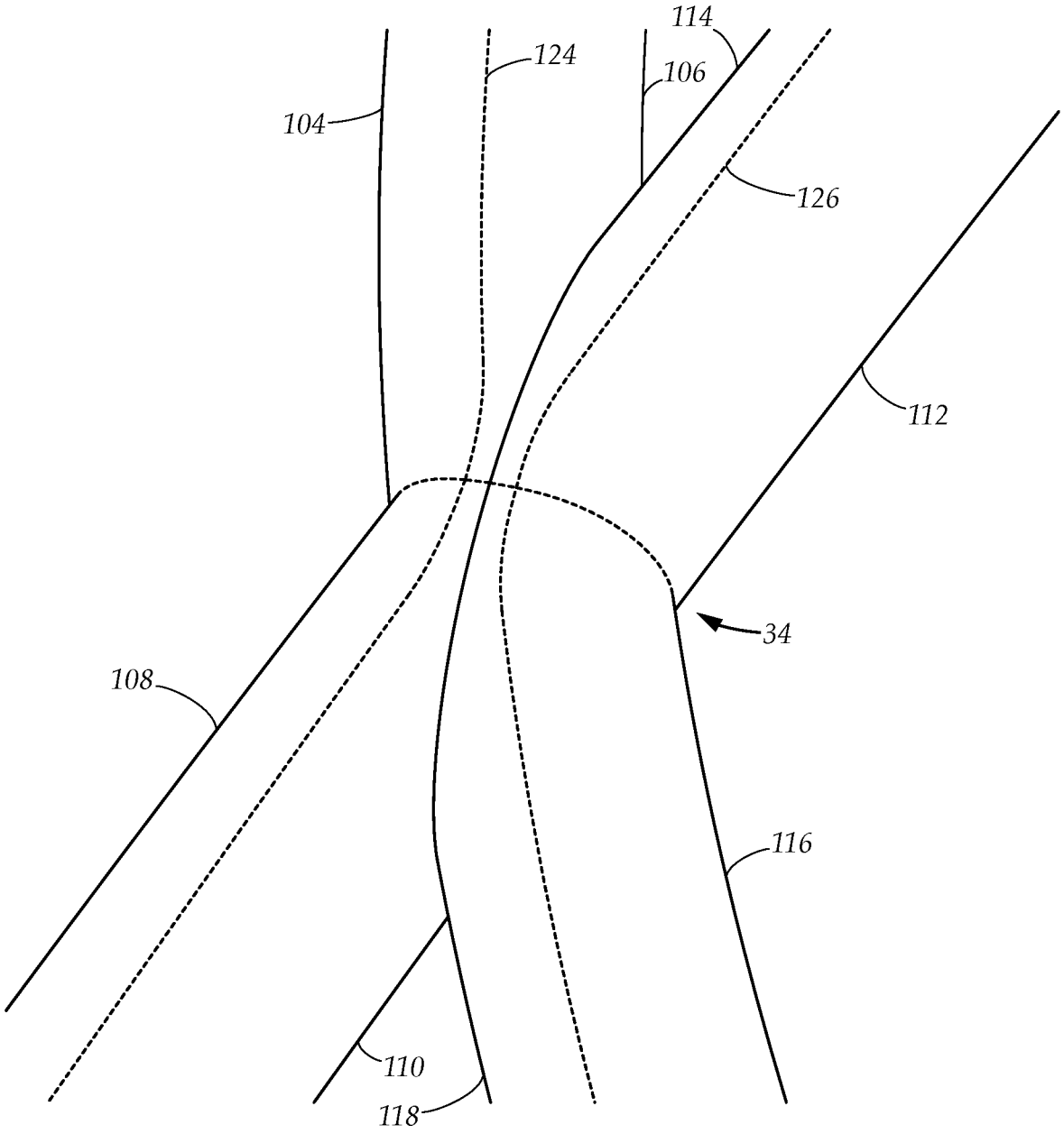
FIG. 12, similar to FIG. 11, is a perspective view of the spar junction.

In other example embodiment, adjoining sleeves 28 are formed with junctions that define the shapes formed by the spars covered by said sleeves. FIGS. 11 and 12 demonstrate a pair of sleeves 28 at the junction 34. The left sleeve 28 has a left upper outer portion 104, and left upper inner portion 106, a left lower outer portion 108 and a left lower inner portion 110. The right sleeve 28 has a right upper outer portion 112, a right upper inner portion 114, a right lower outer portion 116 and a right lower inner portion 118. The sleeves 28 join at an elliptical seam portion 102. The elliptical seam portion 102 is a fabric wall separating a first bladder from a second adjacent bladder so they can neither abrade each other nor expand into the adjoining sleeve 28.

In the configuration shown, the right sleeve has a visible seam 126 joining the inner portions 114, 118 and outer portions 112, 116 and the left sleeve has a visible seam 124 joining the inner portions 106, 110 and the outer portions 104, 108. The right sleeve has an invisible inner seam 122 joining the inner portions 114, 118 and outer portions 112, 116 and the left sleeve has an invisible inner seam 120 joining the inner portions 106, 110 and the outer portions 104, 108.

Figure 14:
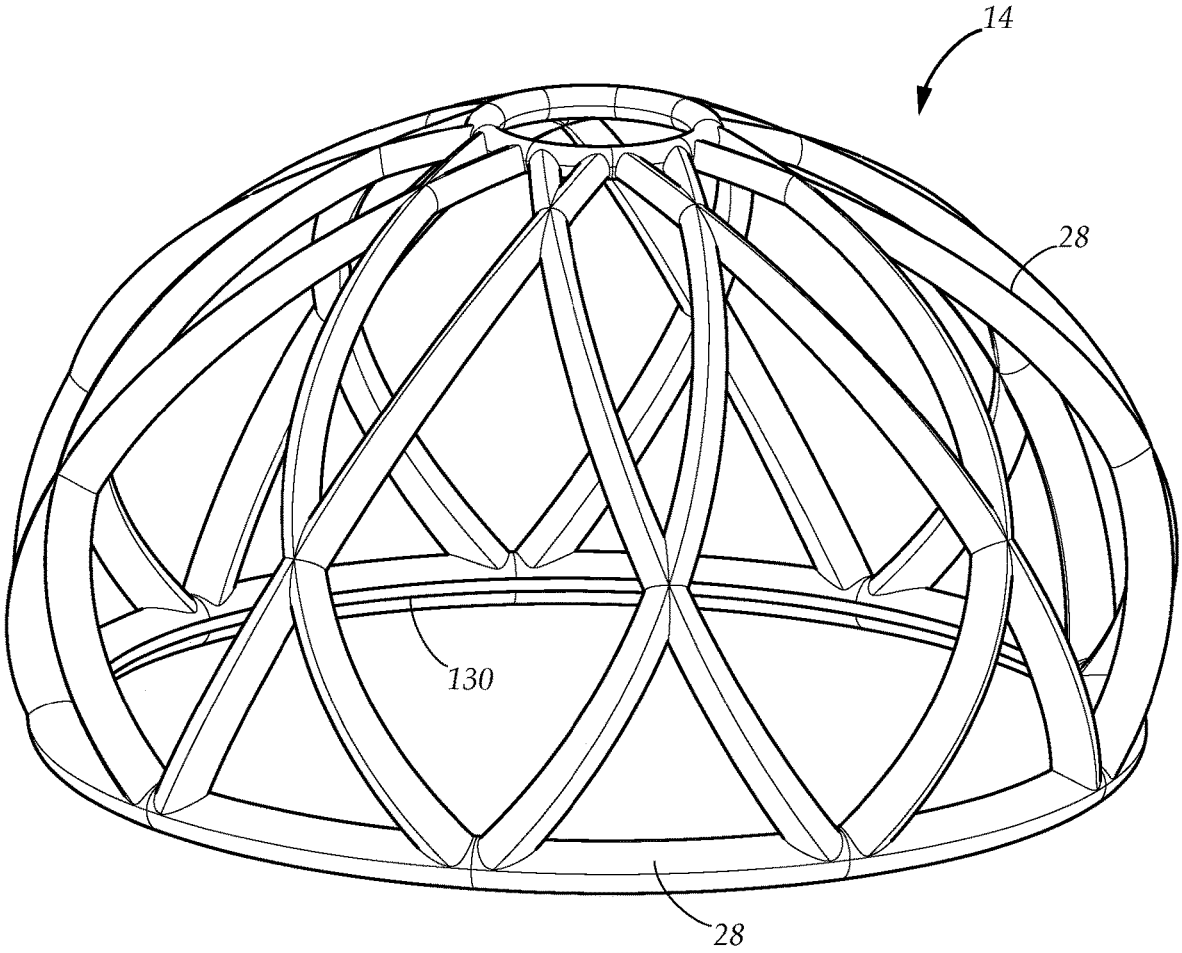
FIG. 14, similar to FIG. 2, is a perspective of another example embodiment of the frame of the dome shelter.

Referring to FIG. 14, in environment conditions that have large temperature swings, the sleeves as described herein-above are modified by inserting an elastic material of suitable elastic modulus to mitigate the effects of said temperature swings. The elastic material allows the sleeves 28 to expand in a manner so as to maintain constant structural pressure when temperatures rise. The increase in sleeve volume due to the expansion of the elastic material accommodates the expanding air within. As shown in FIG. 14, such an elastic expansion strip 130 is sewn into the inner circumference of the base ring sleeve 28.

In the configuration shown in FIGS. 11 and 12, the visible seams 122, 124 veers away from the elliptical seam 102 and the invisible inner seams 120, 122 meet at the elliptical seam 102.

In another configuration which is not shown, the visible seams 122, 124 meet at the elliptical seam 102 and the invisible inner seams 120, 122 veer away from the elliptical seam 102.

In a further configuration not show, the visible seams 122, 124 and the invisible inner seams 120, 122 veer away from the elliptical seam 102.

Figure 4A:
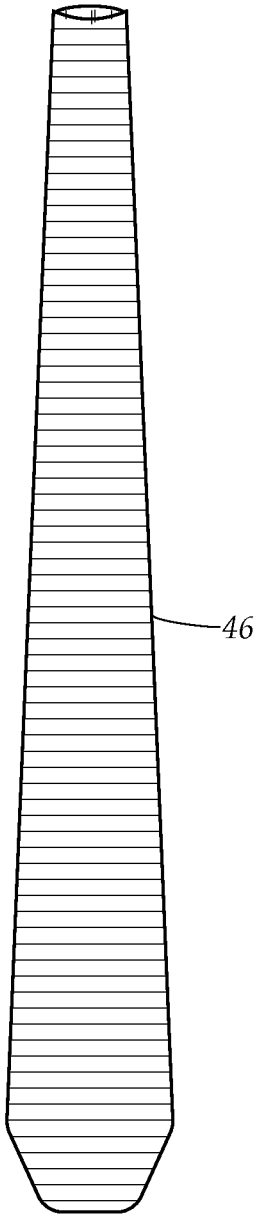
FIG. 4A is a front elevational view of an example embodiment of a sleeve for covering a spar.
Figure 4B:
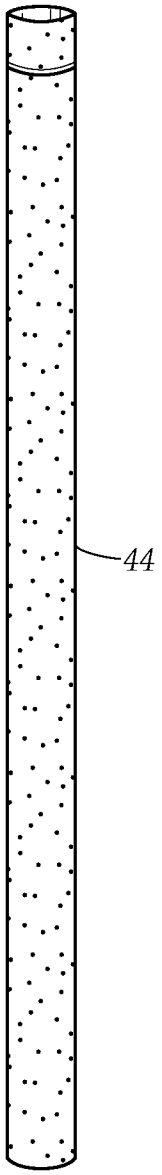
FIG. 4B is a front elevational view of an example embodiment of a bladder portion of the spar.
Figure 4C:
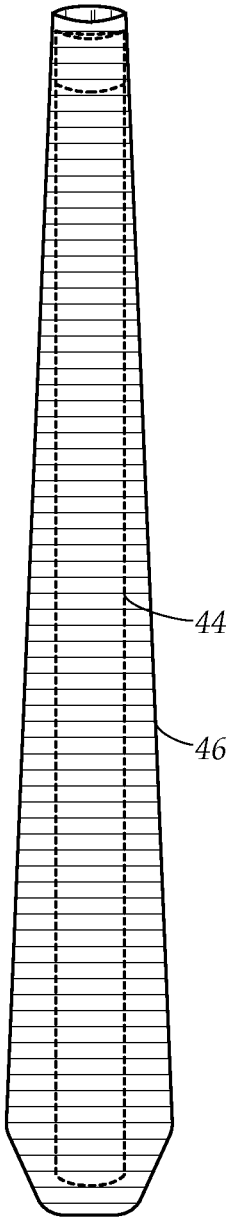
FIG. 4C is a front elevational view of an example embodiment of the bladder portion inside a sleeve of the spar.

FIGS. 4A-4B show the special structure of the spars described herein above. A bladder 44 sits inside a spar sleeve 46. In one example embodiment, the bladder is constructed from food-grade material capable of sanitization to allow the option of storing potable water in place of air. The bladders 44 are selectively replaceable within the sleeve 46.

Figure 5A:
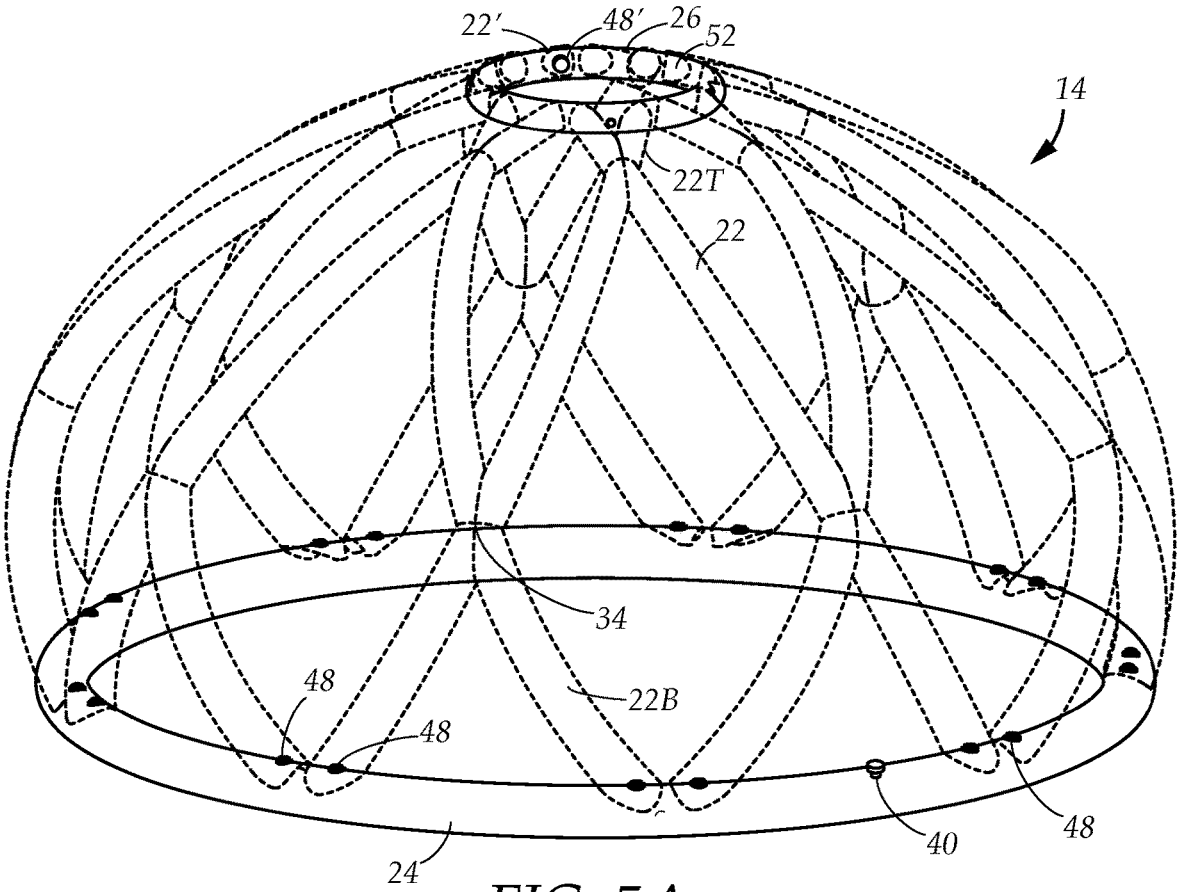
FIG. 5A is an example embodiment of the frame shown without the sleeves for clarity.
Figure 5B:
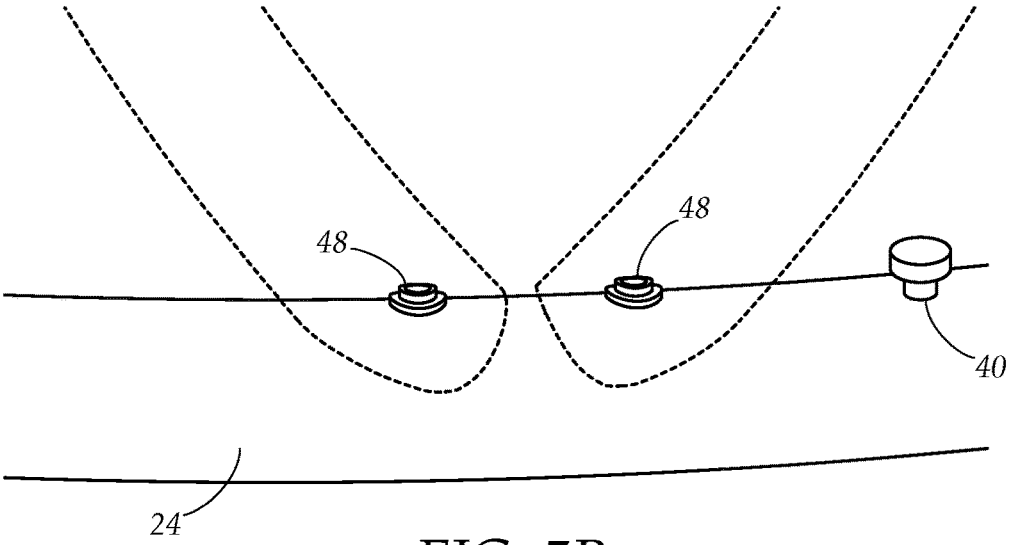
FIG. 5B is a perspective view of a plurality of valves at a junction of the spars with a base ring, showing a plurality of internal valves.

FIGS. 5A and 5B show the structure of the frame 14. The spars 22 are shown in outline in order to show the placement of the valves as explained hereinbelow. In one example embodiment, each spar 22 has a bottom section 22B that attaches to the base ring 24, connecting to the base ring through a check valve 48. The base ring 24 has a valve 40 for filling. As shown in FIG. 5B, there are openings 32 below each spar 22 so that a defective bladder may be removed from the check valve and replaced.

Figure 13:
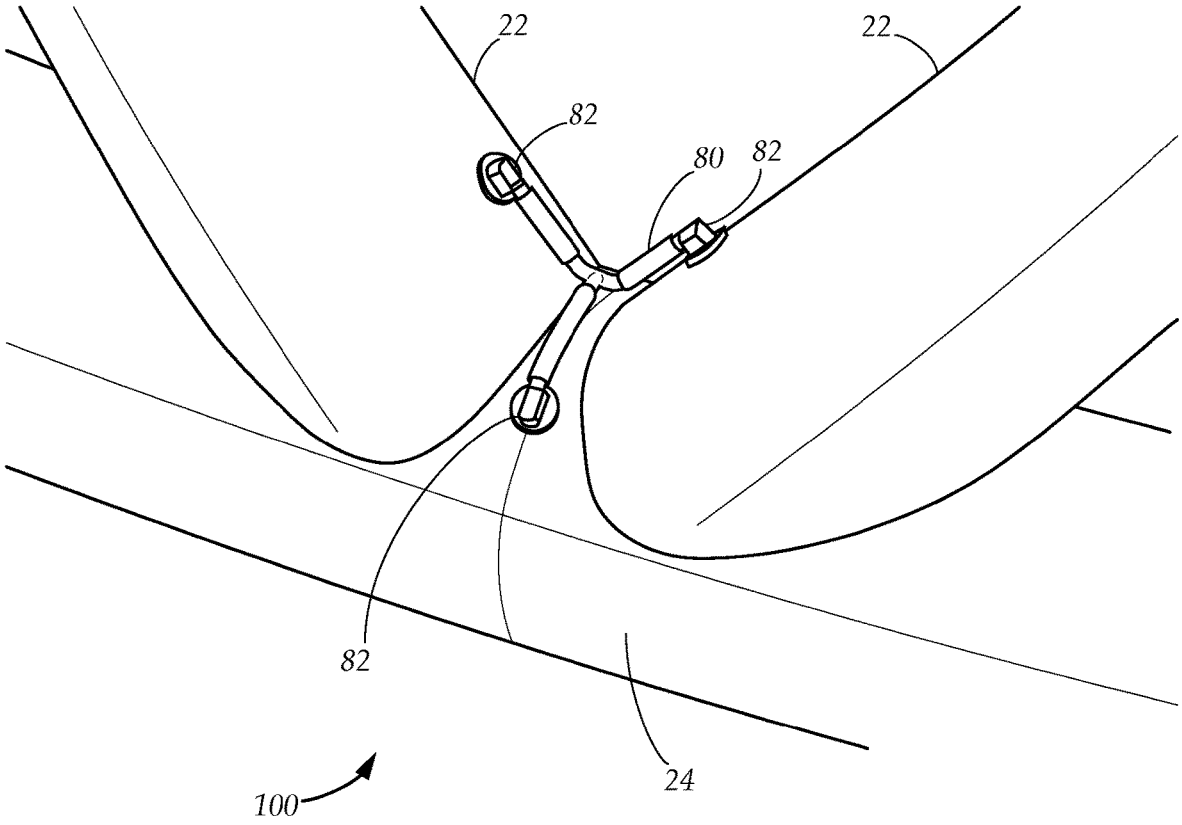
FIG. 13, similar to FIG. 5B, is a perspective view of a plurality of external valves at the junction of the spars with the base ring.

In another example embodiment shown in FIG. 13, an alternate configuration employing open airways is preferable in some circumstances. For example, if the use that the dome shelter provides for has a high probability of puncture, it is desirable to close off the damaged spar 22 so that the remaining spars remain inflated. Additionally, in environments where rapid and large temperature swings are expected, open valves 82 may be preferred, so the pressure can be evenly distributed through-out the unitary frame.

The base ring bladder 24, acting as a manifold 100 to inflate the spars 22, has a plurality of open valves 82 protruding through the base ring sleeve 28 at the spar junction. Accordingly, the bottom of each spar 22 also has an open valve 82 Each of these three valves 82 are in fluid communication through a 3-way tube 80. These triple sets of connected valves are disposed at each junction of two spars 22 with the base ring 24 as well as where one spar 22 is in fluid communication with the top ring.

In normal operation, this configuration will allow the free flow of air and the equalization of pressure throughout the structure. In the case of a puncture, a clamp may be used to isolate the leaking spar 22 so the remaining spars 22 may be inflated and retain pressure. This allows the repair of the damaged bladder while the remainder of the structure stays intact.

The spars 22 have a top portion 22T. One of the spars 22' connects to the top ring 26 through a valve 48' that allows the top ring to inflate. The other spars 22 have a dead end 52 where the top portion 22T attaches to the top ring 26.

In one example embodiment, the valve 48' is a check valve. In another example embodiment the valve 48' is an open valve.

Air is pumped through the valve 40 and the bottom ring 24 acts as a manifold, allowing all the spars 22 to fill at the same time as the air flows through the check valves 48. When the one spar 22' with the valve 48' is filled, air moves to fill the top ring 26. When the sleeves are in place, the structure forms the triangular shapes 36 and quadrangular shapes 38 of the frame. It is understood that other fluids beside air may be used to fill the spars 22 and rings, such as potable water.

Figure 6:
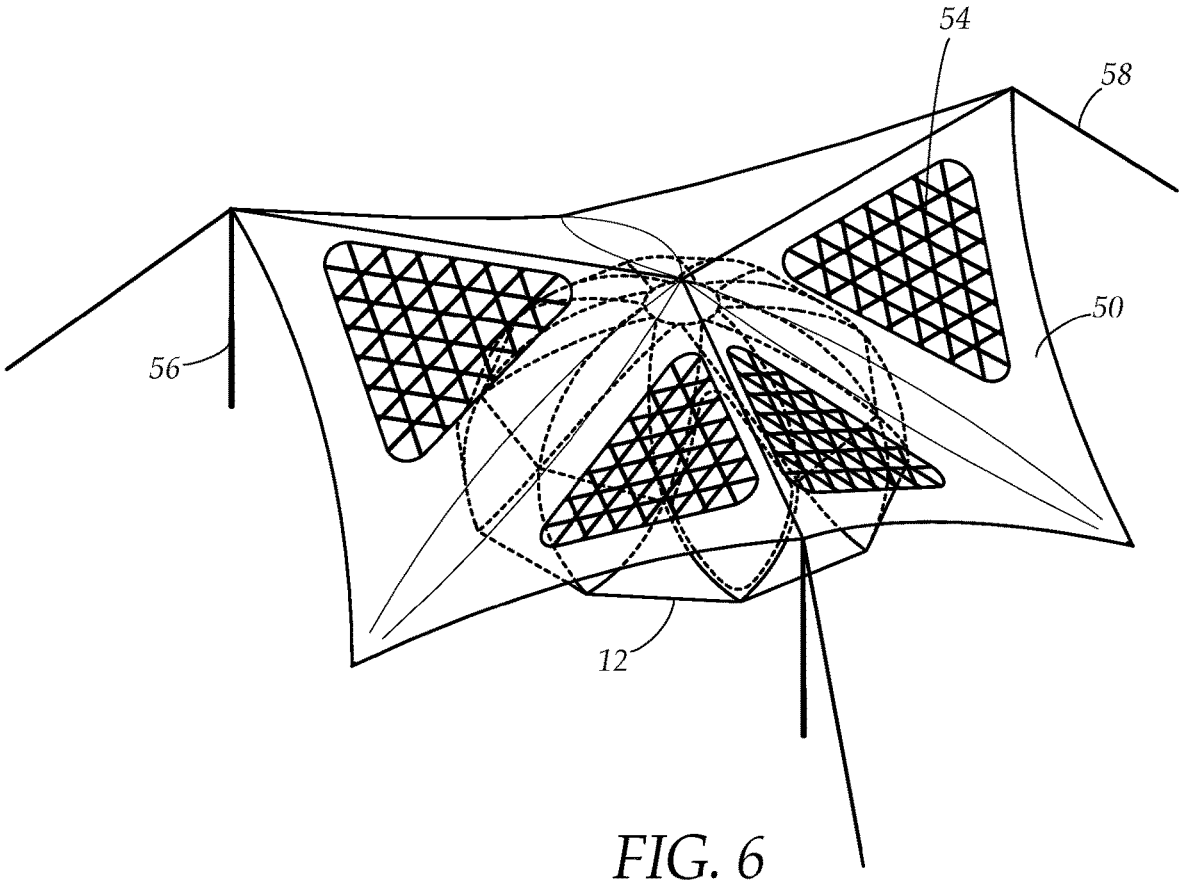
FIG. 6 is a perspective view of a dome shelter covered by a canopy.

FIG. 6 shows the dome shelter 12 under a sail shade 50. The sail shade 50 can attach to a plurality of storm poles 56. Rigging 58 anchors the sail shade 50 and dome shelter 12 and is attached to a stake or other attachment means in the ground. The sail shade 50 selectively has a plurality of solar panels 54. Various rigging 58 attachment points make the sail shade 50 easy to assemble and disassemble. The sail shade 50 can either cover the entire dome shelter or partially cover a section.

Figure 7:
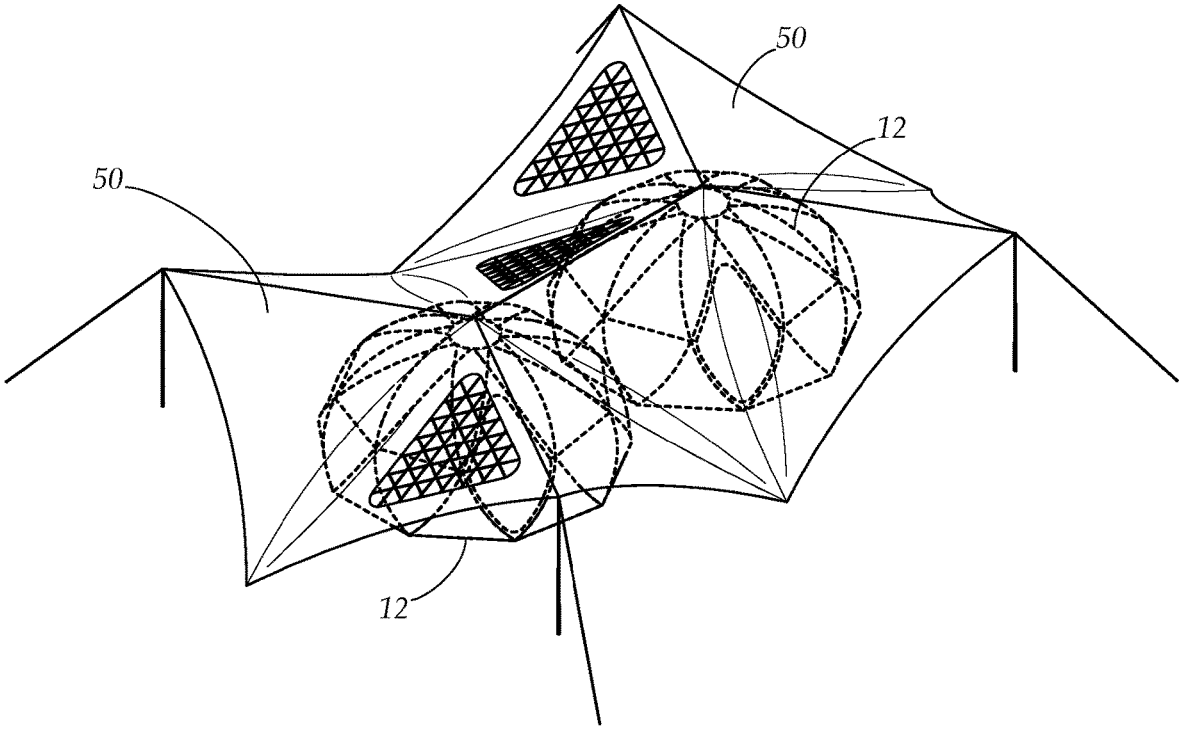
FIG. 7 is a perspective view of a pair of dome shelters covered by coupled canopies.

FIG. 7 shows a pair of dome shelters 12 under a joined pair of sail shades 50. The outer shells 16 of the dome shelters 12 may connect directly as shown or through a tunnel (not shown.) The sail shades 50 may join each other via zipper. The sail shades 50 utilize stretch fabric to automatically open vents when unzipped. The sail shades 50 are shaped in such a way as to tessellate perfectly above a cluster of dome shelters 12. The sail shades 50 add an additional layer of protection from the sun and elements.

Figure 8:
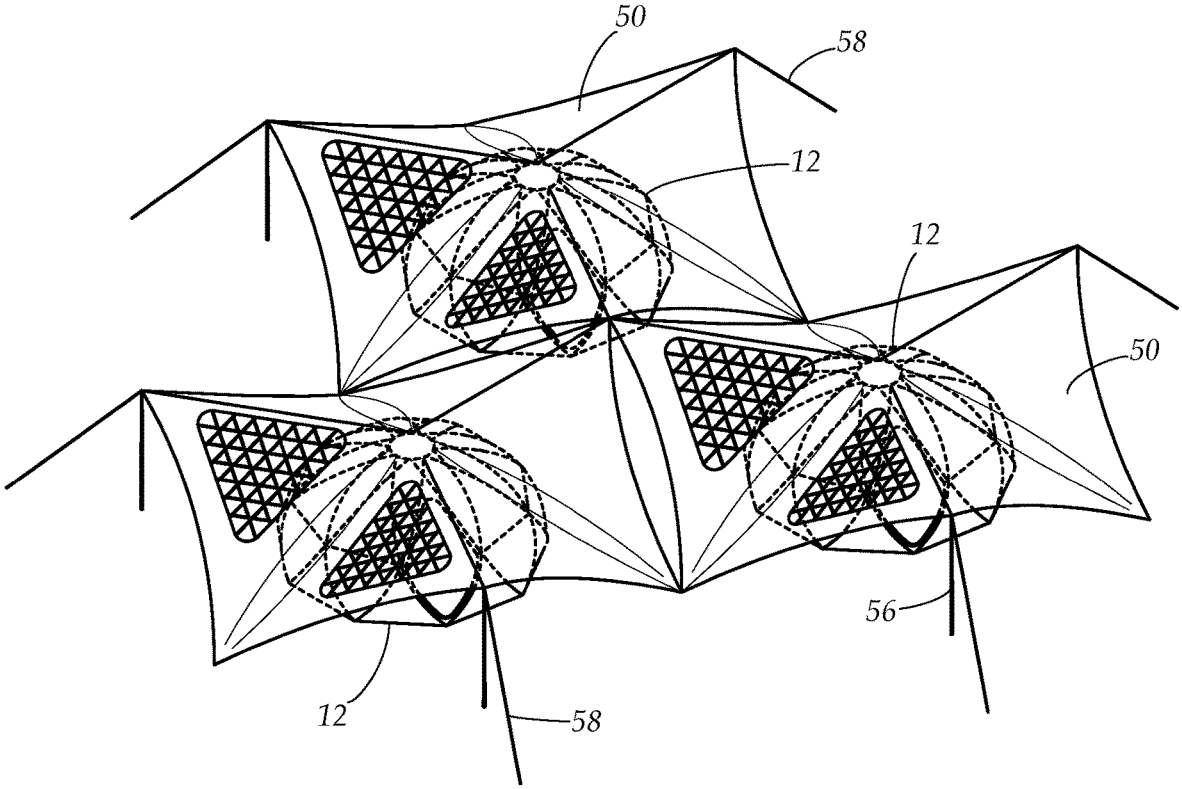
FIG. 8 is a perspective view of a plurality of dome shelters covered by a plurality of coupled canopies.
Figure 9:
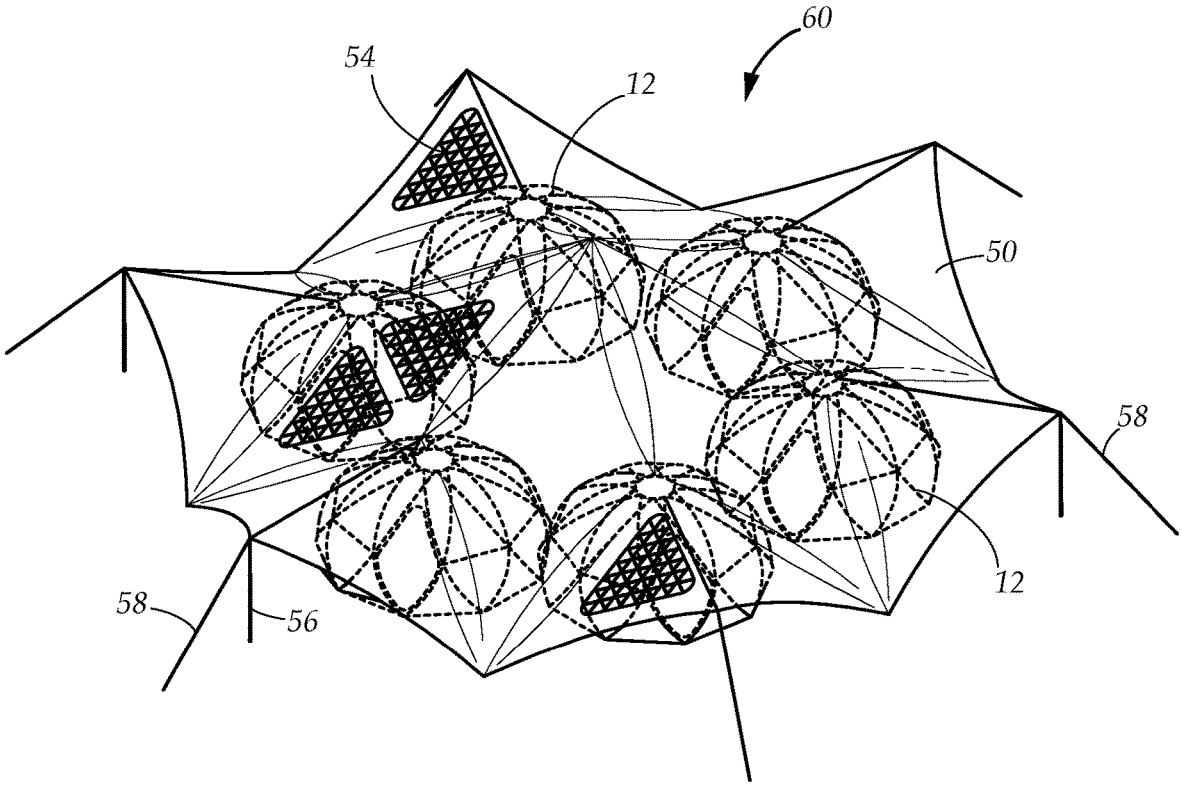
FIG. 9 is a perspective view of another example embodiment of a plurality of coupled dome shelters covered by a plurality of coupled canopies arranged in a circle.
Figure 10:
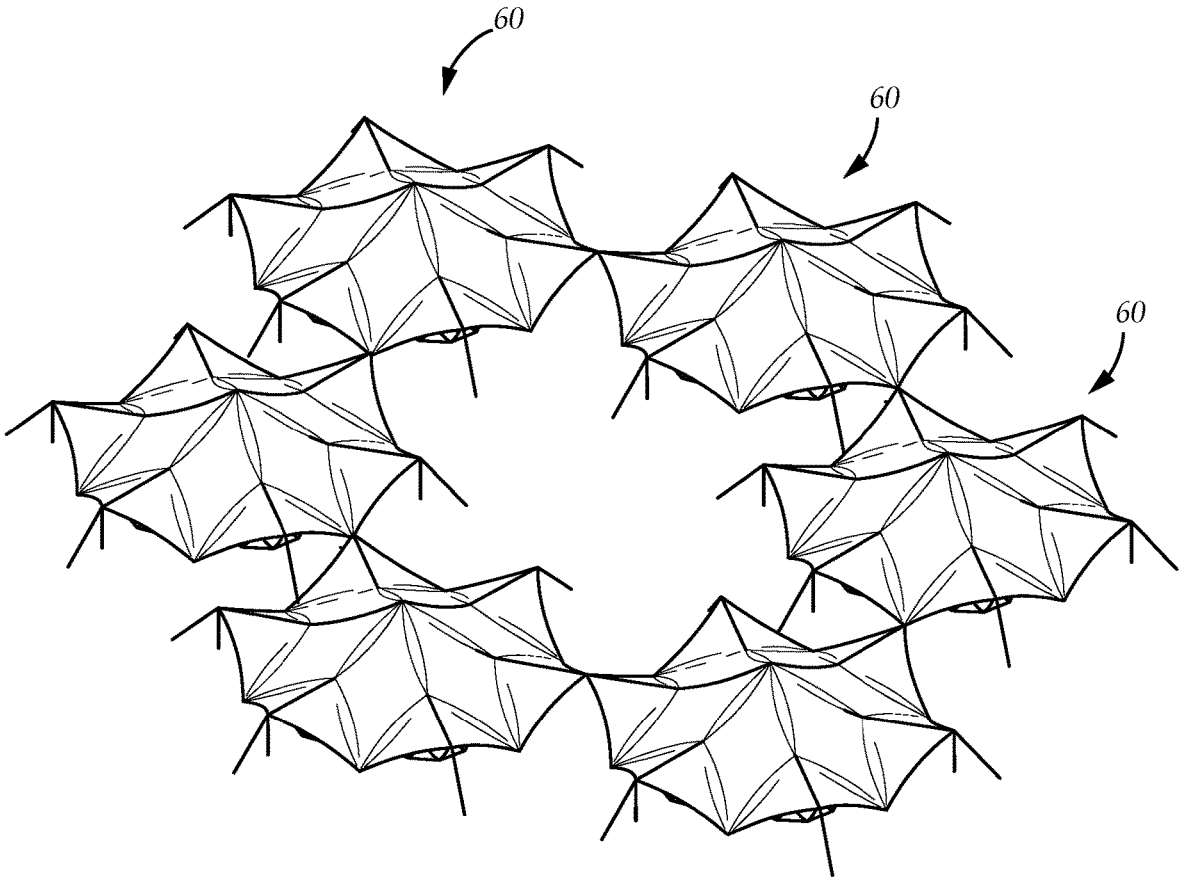
FIG. 10 is a perspective view of a plurality of circles of coupled dome shelters arranged in a village.

FIGS. 8-10 show different configurations of dome shelters 12 and sail shades 50, using rigging 58 and storm poles 56. FIG. 9 shows how the dome shelters 12 and sun shades 50 form a cluster 60 of shelters under one protective canopy formed by joining a number of sail shades 50. The unique shape of the sail shades 50 permits the arrangement in such a tessellated pattern as shown. FIG. 10 shows how the clusters 60 can be set up to be a village with all the necessary structures to house a small population.

Figure 15:
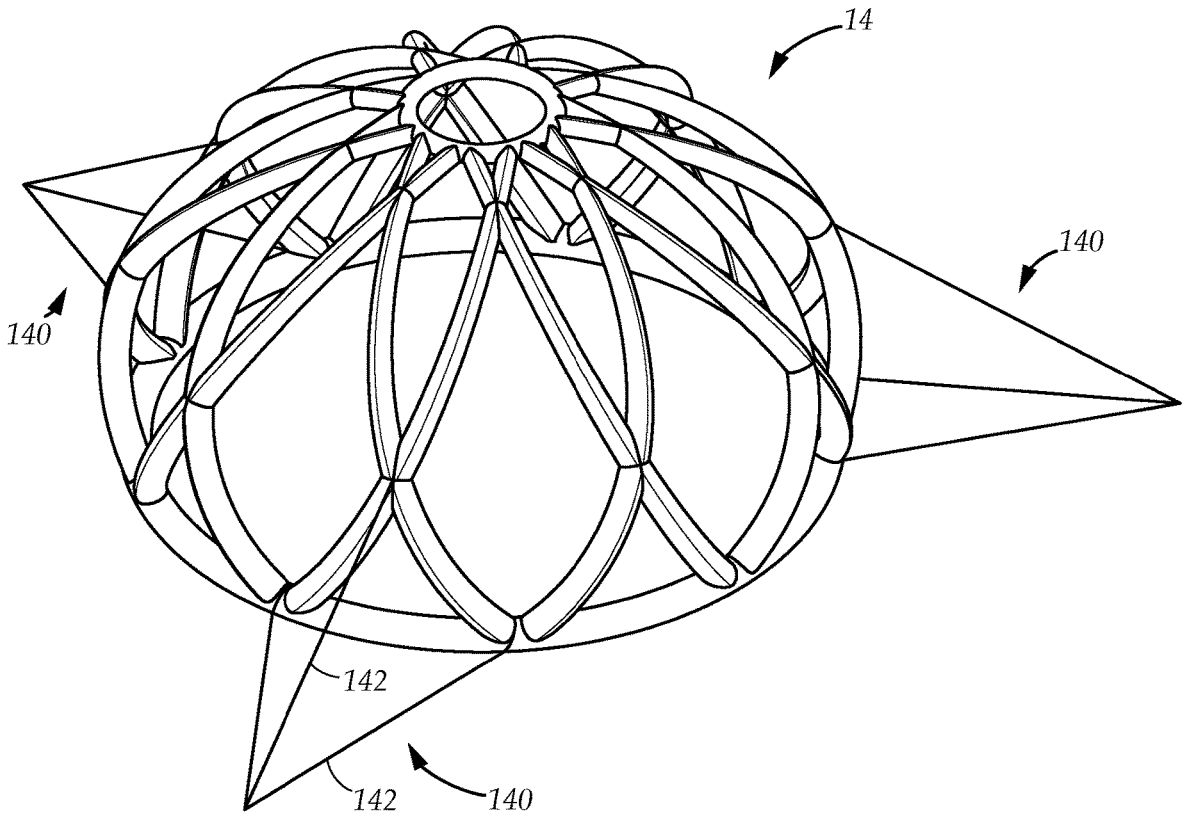
FIG. 15 is a perspective view of a rigging system for stabilizing the dome shelter.

A power system (not shown) provides inflation by powering an air pump, lighting by powering LED lighting, and also powering a computing device, thereby providing connectivity and auxiliary charging ports for other devices. The power system may include a battery for storing energy generated by the solar panels 54. The computing device is capable of wireless communication allowing a number of dome shelters to wirelessly share information as well as monitor internal and external environmental conditions, the internal pressure within the dome shelters 12 and the domes' frames. LED lighting may be integrated with the outer shell or the inner shell. In another example embodiment, a device integrates into the frame which combines a solar panel, a plurality of batteries, a fluid pump, a pressure sensor, a logic circuit for pressure regulation, a computer with wireless communication capability, and accessory charging outlets FIG. 15 shows rigging system for anchoring the dome shelter. The dome shelter unitary frame 14 is preferably tethered by three storm bridles 140, each connecting the dome shelter unitary frame 14 to the ground. This rigging system enhances the structural stability of the inflatable shelter, and also keeps it in place, anchored to the ground during high winds and heavy precipitation. Each bridle 140 has three cables 142, two attaching to two adjoining junctions of a pair of spars with the base ring and one attaching at a spar junction. The three cables join together at a stake in the ground.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented an inflatable shelter and a system for creating a portable shelter village. The disclosure is illustrated by example in the drawing figures, and throughout the written description. It should be understood that numerous variations are possible, while adhering to the inventive concept. Such variations are contemplated as being a part of the present disclosure.

What is claimed is:

1. A dome shelter, comprising:

an outer shell;

an inflatable unitary frame having a plurality of spars, a bottom ring and a top ring forming a hemisphere, the plurality of spars, the bottom ring and the top ring each having a bladder in fluid communication within the inflatable unitary frame, the plurality of spars fluidly connecting to the bottom ring and attaching to a top ring, a single spar of the plurality of spars fluidly connecting to the top ring, the outer shell covering the inflatable unitary frame;

a plurality of sleeves covering the bladders of the spars, the bottom ring and the top ring, the sleeves of the spars connecting the spars to form a plurality of triangles and a plurality of diamonds forming the inflatable unitary frame by forming a plurality of junctions, each junction having a plurality of seams of the sleeves meeting at an elliptical seam in a center of each junction, the center of each junction having a plurality of temporary couplings;

a plurality of check valves fluidly connecting the bladders of the plurality of spars with the bottom ring and a check valve fluidly connecting one bladder of one spar with the top ring, the inflatable unitary frame is fillable through an external valve, the external valve fluidly connecting to the bladders of the plurality of spars, the bottom ring and the top ring.

2. The dome shelter as described in claim 1, wherein three valves connecting through a three-way tube are disposed at a junction of two spars and the base ring, one valve on each spar and one valve on the base ring.

3. The dome shelter as described in claim 2, wherein an open valve fluidly connects a top of one bladder of one spar with the top ring.

4. The dome shelter as described in claim 1, wherein a plurality of bridles, each bridle attaching to the inflatable unitary frame, each bridle having three cables to the unitary frame, a first cable attaching to the junction between two spars and a second cable and a third cable attaching to the junction between the two pairs and the bottom ring, the three cables joining together to an anchor spot in the ground.

5. A dome shelter, comprising:

an inflatable top ring having a top ring inflatable bladder;

an inflatable bottom ring having a bottom ring inflatable bladder;

a plurality of spars, each spar having a spar inflatable bladder, each spar inflatable bladder having a bottom and a top, the bottom of each spar inflatable bladder in fluid communication with the bottom ring inflatable bladder of the bottom ring, the tops of the spar inflatable bladders attaching to the inflatable top ring, the top of the inflatable bladder of a single spar of the plurality of spars in fluid communication with the top ring inflatable bladder of the inflatable top ring, the plurality of spars, the inflatable bottom ring and the inflatable bottom ring forming a unitary frame, fillable through an external valve, the external valve fluidly connecting to the spar inflatable bladders of the plurality of spars, the bottom ring inflatable bladder of the bottom ring and the top ring inflatable bladder of the inflatable top ring;

a plurality of sleeves covering the spar inflatable bladders of the spars, the bottom ring inflatable bladder of the inflatable bottom ring and the top ring inflatable bladder of the inflatable top ring, the sleeves of the spars covering the spars forming a plurality of junctions, each junction having a plurality of seams meeting at an elliptical seam in a center of the junction, each junction having a plurality of temporary couplings meeting at the center of the junction, the sleeves of the spars coupling the spars to form a plurality of triangles and a plurality of diamonds within the unitary frame, the unitary frame forming a hemisphere; and an outer shell covering the unitary frame.

6. The dome shelter as described in claim 5, wherein three valves connecting through a three-way tube are disposed at a junction of two spars and the base ring, one valve on each spar and one valve on the base ring.

7. The dome shelter as described in claim 6, wherein an open valve fluidly connects a top of one bladder of one spar with the top ring.

8. The dome shelter as described in claim 5, wherein a plurality of bridles, each bridle attaching to the unitary frame, each bridle having three cables to the unitary frame, a first cable attaching to the junction between two spars and a second cable and a third cable attaching to the junction between the two pairs and the bottom ring, the three cables joining together to an anchor spot in the ground.

9. A system for providing a plurality of structures to house a population, comprising:

a plurality of dome shelters, said plurality of dome shelters each having a unitary frame formed from a plurality of fluidly connected inflatable bladders forming a hemisphere, the hemisphere covered by an outer shell; and a plurality of bridles, each bridle attaching to each unitary frame, each bridle having three cables attaching to the unitary frame, a first cable attaching to a first junction between a first pair of spars having a first spar and a second spar, a second cable attaching to a second junction between a bottom ring and a first spar and a third cable attaching to a third junction between the bottom ring and a second spar, the first cable, the second cable and the third cable joining together and attaching to an in-ground anchor spot.

10. The system as described in claim 9, wherein the outer shells of the plurality of dome shelters directly connect to form a larger shelter having a plurality of unitary frames, forming a cluster.

* * * * *